United States Patent [19]

Gaskey et al.

[11] 4,415,382

[45] Nov. 15, 1983

[54] CONTINUOUS ANNEALING APPARATUS AND METHOD

[75] Inventors: Kenneth M. Gaskey, South Holland, Ill.; Indra Gupta, Munster, Ind.; Richard S. Cline, Crete, Ill.

[73] Assignee: Inland Steel Company, Chicago, Ill.

[21] Appl. No.: 310,780

[22] Filed: Oct. 13, 1981

[51] Int. Cl.[3] ..... C21D 1/00

[52] U.S. Cl. ..... 148/153; 266/103

[58] Field of Search ..... 148/153, 13, 155; 266/103, 102

[56] References Cited

U.S. PATENT DOCUMENTS

| | | | |
|---|---|---|---|
| 2,023,285 | 12/1935 | Otis | 266/102 |
| 2,534,973 | 12/1950 | Ipsen et al. | 266/102 |
| 3,496,033 | 2/1970 | Gilbreath et al. | 148/13 |

FOREIGN PATENT DOCUMENTS

| | | | |
|---|---|---|---|
| 30614 | 6/1981 | European Pat. Off. . | |
| 54-164024 | 6/1979 | Japan | 266/103 |

OTHER PUBLICATIONS

Bennett, "Inland Steel's Keeping Pace With Auto Industry Needs", Iron Age, Oct. 5, 1981, pp. MP-29, MP-30.

*Primary Examiner*—L. Dewayne Rutledge
*Assistant Examiner*—Debbie Yee
*Attorney, Agent, or Firm*—Merriam, Marshall & Bicknell

[57] ABSTRACT

A novel pre-quench zone is provided between the soak section and the water quench section of a continuous annealing line. The pre-quench section has multiple passes, and each pass has gas jet cooling tubes and heaters disposed along the path of movement of the strip. By selective operation of the gas jet cooling tubes or the heaters or both, the pre-quench zone provides a wide range of cooling capabilities and cooling rates so as to achieve a quench temperature ranging from 455° C. to 955° C. (850°-1750° F.) using either light or heavy gauge strip and without changing the normal line speed.

13 Claims, 4 Drawing Figures

FIG. 1
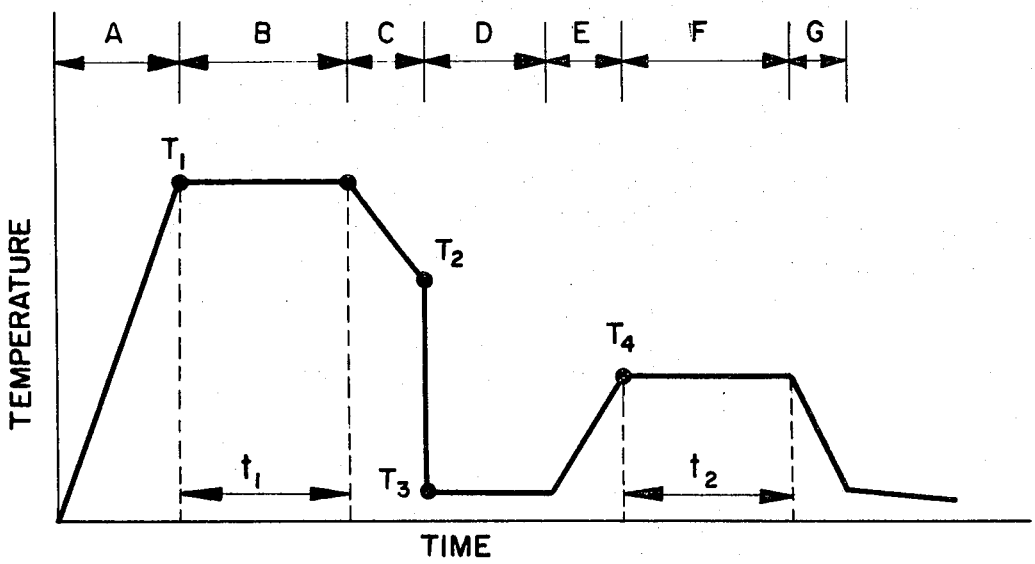
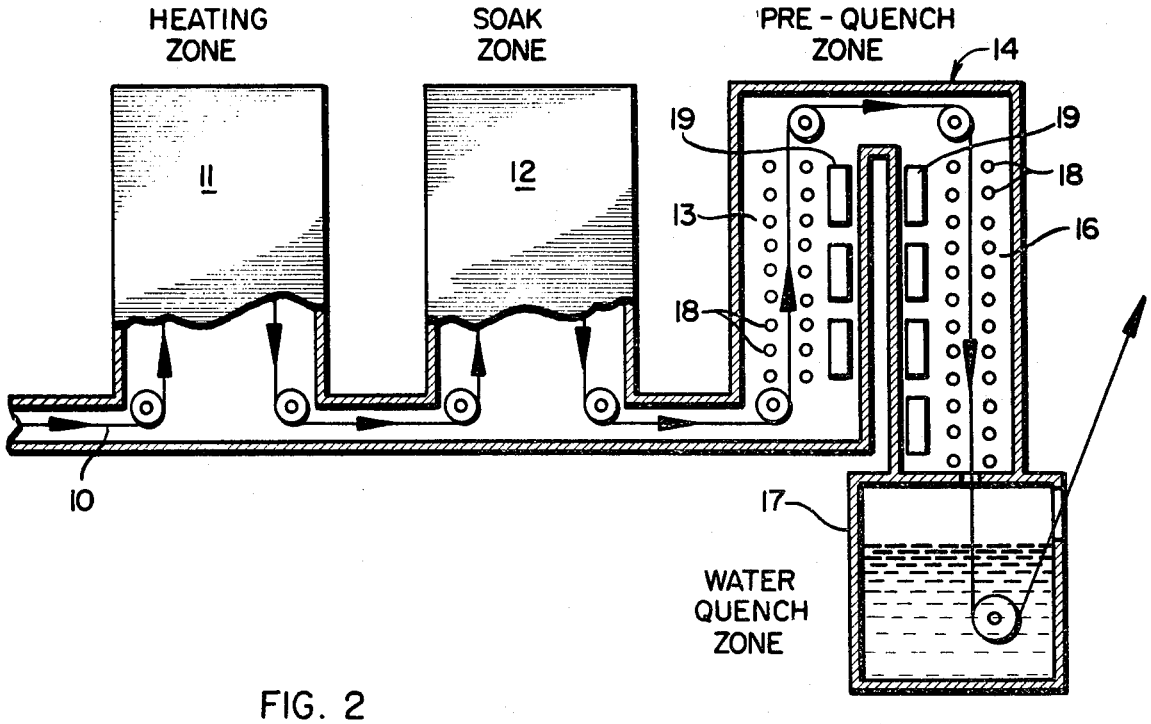
FIG. 2

CONTINUOUS ANNEALING APPARATUS AND METHOD

This invention relates to improvements in the continuous annealing of metal strip, particularly steel strip.

In continuous annealing of steel strip, the strip is rapidly heated to annealing temperature, soaked for a short time, and then cooled or quenched. The annealing temperature and the thermal path during cooling or quenching determine the microstructure and properties of the final product. The continuous annealing lines presently used in the steel industry customarily include gas jet cooling or water quenching or both. In gas jet cooling, a cooling gas is impinged against opposite sides of the moving steel strip to effect cooling of the strip at a relatively slow rate, e.g., not greater than about 28° C./sec. (50° F./sec.). In water quenching, the cooling rate is considerably higher and is generally at least about 555° C./sec. (1,000° F./sec.). Although the simultaneous availability of slow gas jet cooling and rapid water quenching has substantially increased the ability of continuous annealing lines to produce a variety of steel products, nevertheless, it has been found that such lines are still not adequate for certain desirable types of products.

Accordingly, the object of the present invention is to improve the versatility of a continuous annealing line having both gas jet cooling and water quenching by extending the cooling capability and increasing the range of available cooling rates prior to water quenching so that a wider variety of steel products can be produced on a single line using either light or heavy gauge strip and without the necessity of changing the normal line speed.

Other objects and advantages of the invention will be apparent from the following detailed description in conjunction with the accompanying drawings, wherein:

FIG. 1 is a schematic representation of the strip temperature profile in a continuous annealing line;

FIG. 2 is a schematic view of a continuous annealing line with a pre-quench section illustrating the principles of the present invention;

Figures 3, 4:
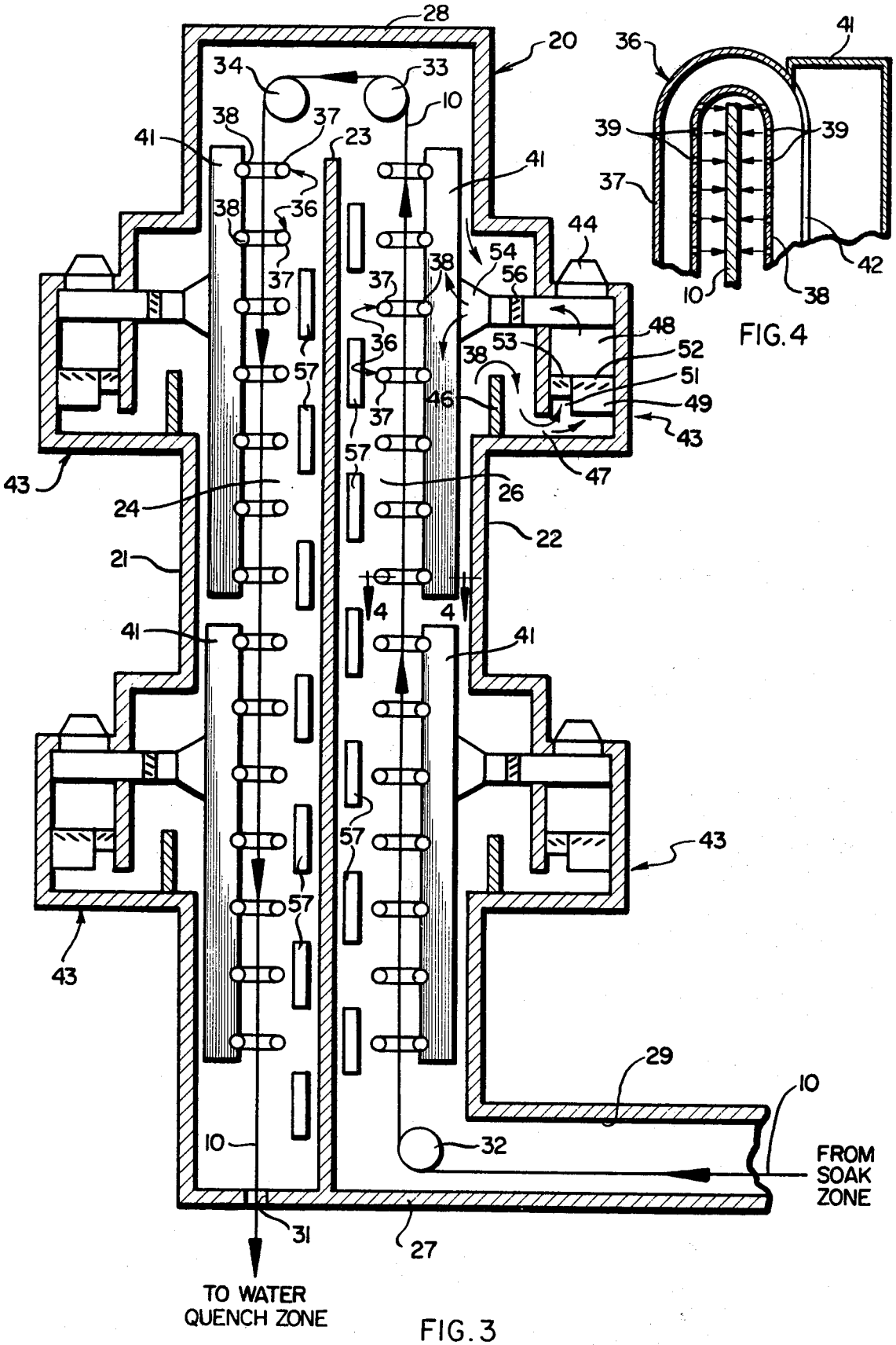
FIG. 3 is an enlarged schematic view of one specific embodiment of the pre-quench section of the line shown in FIG. 2.
FIG. 4 is a partial sectional view taken along the line 4—4 of FIG. 3.

In one of the most versatile of the continuous annealing lines presently used in the steel industry, the steel strip is passed continuously through an annealing section consisting of a heating zone in which the strip is heated to a predetermined annealing temperature, a soak zone in which the annealing temperature is maintained for a short time, a controlled cooling zone in which the strip is cooled relatively slowly by gas jet cooling from its soak temperature to a predetermined quench temperature, and a water quench zone in which the strip is rapidly quenched to substantially the water temperature. Thereafter, the strip passes from the annealing section to a tempering or overaging section having a heating zone in which the strip is reheated to a predetermined sub-critical temperature, a soak zone in which the sub-critical temperature is maintained for a short time, and a cooling zone in which the strip is finally cooled by gas jet cooling.

An idealized temperature profile for a continuous annealing line of the foregoing type is shown in FIG. 1.

Thus, the cold rolled steel strip is heated to a desired annealing temperature $T_1$ in the heating zone designated as A. The strip then passes through the soak zone B where the temperature $T_1$ is maintained for a time period $t_1$ sufficient to permit the steel to attain metallurgical equilibrium at the annealing temperature. In the controlled cooling zone C, the strip is cooled from the temperature $T_1$ to a desired quench temperature $T_2$ by means of gas jet cooling devices that are adapted to impinge multiple streams of cool gas against opposite sides of the moving strip. The cooled strip then enters the water quenching zone D where the temperature of the strip is rapidly lowered from the quench temperature $T_2$ to substantially the water temperature $T_3$. Depending upon the type of product being made, the strip may then pass from the annealing section comprising zones A–D to the tempering of overaging section of the line comprising zones E–G. Usually, the strip will be acid cleaned and rinsed after leaving the water quench zone and before being passed to the overaging section. In zone E, the strip is reheated to a desired sub-critical temperature $T_4$, and this temperature is then maintained in the soak section E for a period of time $t_2$ sufficient to allow the strip to attain the desired properties. Finally, the strip is cooled to substantially ambient temperature in zone G, usually by gas jet cooling.

With a continuous annealing line of the foregoing type, it is desirable to be able to produce a variety of steel products having yield strengths ranging from about 170 MPa (25 ksi) to about 830 MPa (120 ksi) and greater, dependent upon the steel chemistry and microstructure. It has been found, however, that the cooling zone C of the annealing section of the line is a critical portion of the line that determines its ability to produce certain types of steel products efficiently. The quench temperature $T_2$ of the strip as it enters the water quench zone D and the rate at which the strip is cooled from the temperature $T_1$ to the quench temperature $T_2$ (i.e., the residence time of the strip in zone C) are crucial in achieving the desired microstructure and mechanical properties. Consequently, it is important to be able to control both the total cooling and the cooling rate of the strip in zone C with a high degree of accuracy. In particular, it is desirable that the cooling zone C be capable of providing not only the maximum total cooling and the maximum cooling rate when the gas jet cooling devices are operating at their full capacity but also varying lower degrees of total cooling and varying lower cooling rates extending even to the limit where there is substantially no cooling of the strip in zone C.

Heretofore, in a continuous annealing line of the above-described type, the maximum cooling in the zone C has been obtained by operating the gas jet cooling devices at their full capacity. In many instances, however, even the maximum cooling has not been sufficient to achieve a quench temperature $T_2$ that was low enough to obtain the desired microstructure and properties in the quenched product. In such cases, therefore, it was necessary to reduce the line speed by as much as 50% in order to provide a longer cooling time in zone C. Obviously, this was highly undesirable because of the decreased production capacity of the line when operating at lower speeds. On the other hand, the production of certain products, such as martensitic steel strip, requires that the quench temperature $T_2$ be the same as or substantially the same as the temperature $T_1$. Heretofore, in a continuous annealing line of the foregoing type, the minimum cooling in the zone C has been obtained by shutting off the gas jet cooling devices, but there was still a substantial loss of heat from the strip as a result of natural cooling of the strip at a rate determined by the strip thickness and temperature. The extent of natural cooling might be offset by increasing the line speed so as to decrease the residence time of the strip in zone C, but this would result in a decreased residence time in the heating zone A and in the soak zone B that would hinder or prevent attainment of metallurgical equilibrium at the desired annealing temperature. Furthermore, increasing the line speed would have the disadvantage, at least in some cases, of preventing attainment of the minimum quench rate required in zone D for obtaining a desired microstructure. Consequently, it was impossible or very difficult to make products requiring a quench temperature $T_2$ that was the same as or substantially the same as the annealing and soak temperature $T_1$.

In accordance with the present invention, a novel and improved pre-quench zone is interposed between the soak zone B and the water quench zone D that is capable of achieving a desired quench temperature $T_2$ ranging from about 455° C. to about 955° C. (850°-1750° F.) without changing the normal line speed. The pre-quench zone has multiple passes (two or more), and each pass is provided not only with gas jet cooling means but also with heating means. Because of the multiple pass arrangement, the cooling capability of the pre-quench zone at normal line speed is sufficient to achieve any desired low quench temperature, e.g., as low as about 455° C. (850° F.). Thus, greater cooling than in conventional annealing lines can be achieved without loss of productivity by turning off the heating means and operating the gas jet cooling devices at high or full capacity. On the other hand, by turning off the gas jet cooling means and turning on the heating means, the cooling rate of the strip can be retarded below the natural cooling rate that prevails in the absence of positive gas jet cooling and even to the point of substantially zero cooling. Intermediate cooling rates between zero and the maximum cooling rate can be achieved by adjusting the gas jet cooling means without using the heating means or by simultaneous operation of the gas jet cooling means and the heating means.

In FIG. 2, the annealing section of a line incorporating the present invention is shown schematically. The cold rolled steel strip 10 passes upwardly into a heating zone 11 which may have any desired number of passes and wherein the strip is heated to the desired annealing temperature, usually by means of gas-fired radiant tube heaters (not shown). The heated strip emerges downwardly from the heating zone 11 and then passes upwardly into a soak zone 12 which also may have any desired number of passes and is also provided with gas-fired radiant tube heaters or other heating means (not shown). In the soak zone 12 the annealing temperature of the strip is maintained for a suitable length of time to allow the strip to attain metallurgical equilibrium.

The strip emerges downwardly from the soak zone 12 and then passes upwardly into a multiple-pass pre-quench zone designated generally at 14. In order to provide a broader range of cooling capability than has been available heretofore in continuous annealing lines, it is important that the pre-quench zone 14 have two or more passes such that any desired strip quench temperature ranging from about 455° C. to about 955° C. (850°-1750° F.) can be obtained using either light or heavy gauge strip and without the necessity of changing the normal line speed. In most instances two passes will be sufficient, as shown in FIG. 2, but in case of height limitations or other structural restrictions in a particular installation, it may be necessary to use three or more passes in order to provide the required range of cooling capability. In the pre-quench zone 14 the strip passes upwardly through a first chamber 13 and then downwardly through a second chamber 16 and thence directly into a water quench zone 17 which may be of any suitable design capable of rapidly quenching the strip to substantially the water temperature. By way of example, one form of quench system that may be used is described in the Taylor U.S. Pat. No. 3,410,734. From the water quench zone 17, the strip may pass through the tempering or overaging section of the line when such subsequent treatment is required for a particular steel product.

In accordance with the present invention, the chambers 13 and 16 are provided with gas jet cooling tubes 18 disposed along the path of movement of the strip and arranged to impinge cooling gas against opposite sides of the moving strip. In addition, a plurality of independently and selectively operable heaters 19 are also disposed in the chambers 13 and 16 along the path of movement of the strip.

By way of example, one specific type of pre-quench zone that can be used in the present invention is shown schematically in FIGS. 3 and 4. The pre-quench zone comprises an elongated vertically disposed enclosure 20 having a pair of oppositely disposed outer walls 21 and 22 and an intermediate partition wall 23 that divides the interior of the enclosure into a pair of parallel elongated chambers designated at 24 and 26. The partition wall 23 extends to a bottom wall 27 of the enclosure 20 but terminates below a top wall 28 so that the chambers 24 and 26 are interconnected at their upper ends. Although the partition wall 23 dividing the enclosure into separate interconnected chambers is generally advantageous in order to improve the control of the cooling system, it is also possible to omit the partition wall 23. The steel strip 10 emerging from the soak zone of the annealing section enters the bottom of the chamber 26 through an inlet passage 29 and passes upwardly through the chamber 26 and thence downwardly through the chamber 24 and emerges through an exit opening 31 provided with suitable seal means (not shown), such as seal rolls or gas seals. Guide rolls 32, 33 and 34 are provided within the enclosure 20 so as to direct the moving strip in a two-pass path through the enclosure.

The chambers 24 and 26 are provided with gas jet cooling means comprising a plurality of U-shaped tubes designated generally at 36. The tubes 36 are spaced along the path of movement of the strip, and, as best seen in FIG. 4, each tube 36 has parallel inner and outer portions 37 and 38 extending transversely of the strip and disposed closely adjacent the opposite sides of the strip. The inner tube portions 37 are disposed between the strip 10 and the partition wall 23, and the outer tube portions 38 are disposed between the strip 10 and the outer walls 21 and 22 of the enclosure 20. The walls of the tube portions 37 and 38 facing the strip 10 have a plurality of aligned apertures or nozzles 39 so that multiple streams of cooling gas are impinged against the opposite sides of the strip, as indicated by the arrows in FIG. 4.

Each of the chambers 24 and 26 is provided with a plurality of enlongated headers or manifolds 41 extending lengthwise between the strip 10 and the corresponding outer wall 21 or 22 of the enclosure 20. As best seen in FIG. 4, each header 41 is connected to the outer tube portions 38 of a plurality of the U-shaped tubes 36 so that cooling gas can flow from the header 41 through elongated slots or openings 42 in the outermost walls of the tube portions 38. Although FIG. 3 shows a pair of headers 41 in each of the chambers 24 and 26 with each header in flow communication with seven of the cooling tubes 36, it will be understood that any desired number of headers and interconnected cooling tubes may be used. Thus, the enclosure 20 has a plurality (in this case, four) of local gas jet cooling zones each of which is independently controllable.

During the cooling cycle in the pre-quench zone, the enclosure 20 is filled with a non-oxidizing protective atmosphere, e.g., hydrogen or nitrogen or mixtures thereof. Each of the headers 41 is associated with a gas cooling and recirculating means designated generally at 43 and located at the adjacent outer wall of the enclosure 20. The flow path of the recirculating cooling gas is illustrated in FIG. 3 by the arrows in the recirculating means 43 at the upper portion of the chamber 26, but it will be understood that the arrangement is the same in the other recirculating sections of the system. Thus, a recirculating fan 44 is provided in the gas recirculating section 43, and a localized portion of the protective atmosphere is withdrawn from the chamber 26 and passes over a baffle wall 46 and through a restricted opening 47 into a suction passage 48 for the fan 44. In passing from the opening 47 to the suction passage 48, the gas either passes through a water cooled tube-type heat exchanger 49 or is diverted around the heat exchanger 49 through a by-pass passage 51. Adjustable dampers 52 and 53 are provided for regulating the amounts of the gas stream passing through the heat exchanger 49 and the by-pass 51, whereby to control the temperature of the cooled gas. The cooled gas is drawn from the suction passage 48 by the fan 44 and is discharged through an exit portion 54 of the fan housing that is connected to the header 41. An adjustable damper 56 is also provided in the exit portion of the fan housing for further controlling the volume flow rate of the recirculating gas. As the cooled gas is impinged against the opposite sides of the strip 10 for cooling the latter, the temperature of the gas increases and the heated gas is withdrawn and repeatedly cooled and recirculated in the foregoing manner. Usually, the cooling rate of the strip will be controlled primarily by regulating the volume flow rate of the recirculating gas, and the gas cooler or heat exchanger 49 will be relied upon for "fine tuning" or "trim" purposes. Exhaust gas may be removed from the enclosure 20 and fresh gas added (by means not shown) as required to maintain the desired pressure and gas composition.

In addition to the positive gas jet cooling means for the strip 10, a plurality of independently and selectively operable heaters 57 are also provided in the chambers 24 and 26 along the path of movement of the strip 10. The heaters 57 may be gas-fired radiant tube heaters, electrical resistance heaters, or any other suitable heating devices. It is generally sufficient to provide the heaters 57 at only one side of the strip 10 since the heaters will usually be used only when the gas jet cooling system is not in use, but if desired, the heaters 57 may be disposed at both sides of the strip 10. As seen in FIG. 3, it is structurally convenient to locate the heaters 57 at the opposite side of the strip from the headers 41, i.e., between the partition wall 23 and the inner portions 37 of the gas jet cooling tubes 36.

By means of the gas jet cooling tubes 36 and the gas recirculating and cooling means 43, and with the heaters 57 turned off, the strip 10 can be cooled in a controlled manner at either an accelerated cooling rate or a slower cooling rate, usually ranging between about 5.5° and about 22° C./sec. (10° to 40° F./sec.), to achieve a relatively lower quench temperature. With the gas jet cooling tubes 36 also shut off, the moving strip 10 will cool at its natural cooling rate, dependent upon the thickness and temperature of the strip, to obtain an intermediate quench temperature. If the natural cooling rate is still too high, the heaters 57 can be operated to retard the cooling rate of the strip below its natural cooling rate to obtain a relatively higher quench temperature while still maintaining the normal line speed. When necessary for making certain products, the heaters 57 may be operated to offset the natural cooling rate so that the cooling rate of the strip is substantially zero, or at least not more than about 1° C./sec. (2° F./sec.), as it passes through the pre-quench zone. Thus, the annealing temperature $T_1$ becomes also the quench temperature $T_2$.

With a pre-quench zone having combined cooling and heating capabilities as shown in FIGS. 2, 3 and 4, the continuous annealing line provides a range of total cooling capabilities and cooling rates, and a desired quench temperature can be achieved with a high degree of controllability so that a wide variety of steel products can be made on the same line for light and heavy gauges and without the necessity of reducing the normal line speed. For a steel strip of given thickness or gauge and a given steel chemistry, the annealing section of the line is operated by correlating the line speed and the heating rate in the heating and soak zones to obtain a desired annealing temperature $T_1$ and also by correlating the line speed and cooling rate in the pre-quench zone to obtain a desired quench temperature $T_2$, whereby to make a product having the desired microstructure and mechanical properties. Of course, the microstructure and mechanical properties may be further modified in the tempering or overaging section of the line when required for a particular type of product. As an example, the strip thickness may range from about 0.5 to about 1.4 mm (0.02–0.06 in.) and the line speed may range from about 30 to about 180 m/min. (100–600 ft/min.), with higher line speeds being used with lighter gauge strip and lower line speeds being used with heavier gauge strip.

More specifically, the present invention makes it possible to produce on the same line not only the conventional commercial quality and drawing quality steels, partially recrystallized and recovery annealed steels, and lamination steels, but also a variety of high-strength steel products, including dual phase steels, martensitic steels, and steels strengthened by $\epsilon$-carbides. The following are representative non-limiting examples of the operating conditions that could be used to make various types of steel products on a continuous annealing line incorporating the principles of the present invention:

EXAMPLE 1

Commercial quality or drawing quality steel strip is made from steel having a composition (wt. %) of about 0.06% carbon, about 0.2–0.3% manganese, and about 0.04% aluminum. After hot rolling, the strip is coiled at approximately 675°-730° C. (1250°-1350° F.). In the heating and soak sections of the continuous annealing line, the full hard strip is annealed and soaked at a temperature $T_1$ within the range of from about 650° to about 845° C. (1200°-1550° F.) for about one minute to obtain a recrystallized microstructure. When making commercial quality steel strip, the temperature $T_1$ will be in the lower portion of the range, e.g., 650°-730° C. (1200°-1350° F.), and when making drawing quality product, the temperature $T_1$ will be in the upper portion of the range, e.g., 815°-845° C. (1500°-1550° F.). In the pre-quench zone, with the heaters turned off, the strip is gas jet cooled to a quench temperature $T_2$ within the range of from about 480° to about 595° C. (900°-1100° F.) and is thereafter water quenched to substantially the water temperature. The strip is then passed through the tempering or overaging section of the line where it is heated at approximately 400° C. (750° F.) for about one minute in order to remove the solute carbon as cementite.

In the pre-quench zone it is necessary to achieve the aim quench temperature of 480°-595° C. (900°-1100° F.) because with higher quench temperatures the product is likely to have lower ductility and formability due to a large number of matrix carbides. On a conventional water quench continuous annealing line the strip cannot be cooled reliably from about 845° C. (1550° F.) to 480°-595° C. (900°-1100° F.) without a substantial reduction in line speed resulting in loss of productivity. With the pre-quench system of the present invention, however, the desired quench temperature is easily achieved without loss of productivity.

EXAMPLE 2

A steel strip product having a minimum yield strength of about 276 MPa (40 ksi) is made from a steel having a composition (wt. %) of about 0.06% carbon, about 0.3-0.5% manganese, and about 0.04% aluminum. After hot rolling, the steel is coiled at a somewhat lower temperature than in Example 1, e.g., from about 540° C. to about 595° C. (1000°-1100° F.), and the full hard product is then processed in the continuous annealing line in essentially the same manner described in Example 1 except that the annealing temperature $T_1$ is from about 650° C. to about 790° C. (1200°-1450° F.). As a result of the lower hot mill coiling temperature, the product has a higher yield strength than the commercial quality or drawing quality product of Example 1 even without the presence of $\epsilon$-carbides. Further improvement in the yield strength of the product, e.g., up to about 414 MPa (60 ksi), can be obtained by modifying the steel chemistry, e.g., by the addition of solid solution strengthening elements (silicon and phosphorus) or alloying elements (columbium, titanium, and vanadium), in which case the foregoing annealing temperature range may be changed accordingly.

EXAMPLE 3

By a modification of the continuous annealing line sequence, a steel having the same nominal composition as in Example 2 is processed to obtain a product having a minimum yield strength of about 345 MPa (50 ksi) and ranging as high as about 483 MPa (70 ksi). Since the solubility of carbon in ferrite is maximum at or near the $A_1$ critical point, maximum carbon can be retained in solid solution by quenching from that temperature, and thereafter strengthening of the steel can be effected by precipitation of $\epsilon$-carbides in the overaging section of the line. Thus, the hot mill coiling temperature is the same as in Example 2, but in the continuous annealing line the strip is heated to an annealing temperature of from about 695° to about 725° C. (1280°-1340° F.) for about one minute. In the pre-quench zone, the gas jet cooling devices are shut off, and the heaters are operated to achieve substantially a zero cooling rate so that the quench temperature is essentially the same as the annealing temperature. Thereafter, the strip is overaged by heating to a temperature of from about 230° C. to about 260° C. (450°-500° F.) for about one minute to effect adequate carbide precipitation. By enriching the steel with solid solution strengthening elements or alloying elements, as discussed above in Example 2, a yield strength in excess of 345 MPa (50 ksi) can be achieved.

EXAMPLE 4

A dual phase steel with low strain hardening exponent value (e.g., "n" value less than 0.2 and a relatively high yield strength to tensile strength ratio) is made from a steel having a composition (wt. %) of about 0.1% max. carbon, about 0.5% manganese, about 0.04% aluminum, and added silicon and/or phosphorus as optional, depending upon the desired strength. In general, the low "n" value dual phase steels will contain low levels of manganese, i.e., less than about 0.8%. The full hard steel strip is heated in the continuous annealing line to an annealing temperature above the $A_1$ critical point to achieve a desired volume fraction of austenite in the microstructure. For example, the strip is heated to a temperature of from about 760° to about 790° C. (1400°-1450° F.) for about one minute. This temperature is maintained in the pre-quench zone by shutting off the gas jet cooling means and activating the heaters so that the quench temperature is the same as the annealing temperature. Upon water-quenching, the austenite phase present at the annealing temperature is transformed substantially completely to martensite. The strip is then tempered at a temperature from about 230° to about 260° C. (450°-500° F.) for about one minute in the tempering or overaging section of the line.

EXAMPLE 5

A dual phase steel product with a high strain hardening exponent value (e.g., "n" value greater than 0.2 and a relatively low yield strength to tensile strength ratio) is made from a steel having a composition (wt. %) of about 0.06-0.15% carbon, about 1.5% manganese, about 0.04% aluminum, and with added silicon and/or phosphorus as optional, depending upon the desired strength. The high "n" value dual phase steels will generally contain higher levels of manganese, i.e., greater than 1.0%. The full hard steel strip is heated in the continuous annealing line to an annealing temperature above the $A_1$ critical point, e.g., a temperature of from about 760° to 790° C. (1400°-1450° F.) for about one minute. In the pre-quench zone, the heaters are turned off and the gas jet cooling devices are operated to cool the strip to a quench temperature of from about 455° to about 540° C. (850°-1000° F.), and the strip is then water-quenched. The quench temperature for this product is critical. Depending upon the composition, a quench temperature that is too low will result in the transformation of austenite to pearlite, and a quench temperature that is too high will yield too much martensite in the microstructure, resulting in an excessively high yield strength and an undesirably low ductility.

Although tempering is optional, the strip will usually be tempered at a temperature of from about 175° to about 205° C. (350°-400° F.) for about one minute in the tempering or overaging section of the line.

In a conventional water quench continuous annealing line it would be necessary to reduce the line speed substantially in order to achieve a quench temperature of 455°-540° C. (850°-1000° F.), whereas in accordance with the present invention the normal line speed can be maintained.

EXAMPLE 6

A fully martensitic steel strip product, e.g., as disclosed in the McFarland U.S. Pat. No. 3,378,360, is made from a steel having a composition (wt. %) of about 0.03-0.25% carbon, and about 0.20 to 0.60% manganese. The full hard strip is heated to an annealing temperature above the $A_3$ critical point in the heating and soak zones of the line in order to achieve a fully austenitic microstructure. For example, depending upon the carbon content, the strip is heated to a temperature of from about 830° to about 955° C. (1525°-1750° F.). In the pre-quench zone, the gas jet cooling devices are shut off, and the heaters are used so as to maintain a quench temperature that is essentially the same as the annealing temperature. The strip is then water quenched to effect complete transformation of the austenite to martensite. Any desired degree of tempering may then be effected by heating the strip to a temperature of from about 180° to about 400° C. (350°-750° F.) for about one minute in the tempering or overaging section of the line.

In a conventional water quench continuous annealing line it would be impossible to maintain a quench temperature essentially the same as the annealing temperature because even with no gas jet cooling the natural cooling of the strip (which is greater at high temperatures) would result in detrimental lowering of the quench temperature. In the system of the present invention, however, the use of the heating capability in the pre-quench zone permits the desired quench temperature to be achieved easily.

We claim:

1. In a continuous annealing apparatus for metal strip having a heating zone wherein the strip is heated to an elevated temperature, a soak zone wherein the heated strip is maintained at an elevated temperature, a water quench zone wherein the heated strip is quenched, and means for moving the strip successively through said zones;

the improvement wherein a pre-quench zone is interposed between said soak zone and said water quench zone, said pre-quench zone comprising:

an enclosure means;

means for directing the strip through said enclosure means in a plurality of passes;

gas jet cooling means disposed in said enclosure means along the path of movement of the strip and arranged to impinge cooling gas against opposite sides of the moving strip for effecting controlled cooling of the strip to a desired quench temperature; and a plurality of gas-fired radiant tube heaters or electrical resistance heaters disposed in said enclosure means along the path of movement of the strip, said heaters being operable to retard the cooling rate of the strip below the natural cooling rate prevailing when said cooling means is not in use, without reducing the speed of the strip through said enclosure means.

2. The apparatus of claim 1 wherein the cooling capability of said pre-quench zone is such that a desired quench temperature of from about 455° C. to about 955° C. (850°-1750° F.) is obtainable using either light or heavy gauge strip and without changing the normal line speed.

3. The apparatus of claim 1 wherein said enclosure means comprises a plurality of elongated interconnected chambers defining a multiple pass path of movement of said strip.

4. The apparatus of claim 1 wherein said cooling means comprises a plurality of generally U-shaped tubes with spaced parallel portions extending transversely of the strip closely adjacent the opposite sides of the strip.

5. The apparatus of claim 1 wherein said heaters are disposed at one side of the strip.

6. The apparatus of claim 5 wherein said cooling means comprises a plurality of generally U-shaped tubes with spaced parallel portions extending transversely of the strip closely adjacent the opposite sides of the strip, one of said portions being disposed between said heaters and said one side of the strip, and the other of said portions being disposed at the other side of the strip.

7. The apparatus of claim 1 wherein said cooling means comprises a plurality of gas jet cooling tubes, and said apparatus further comprises:

elongated header means connected to a plurality of said cooling tubes; and gas recirculating and cooling means arranged for withdrawing gas from said chambers, cooling all or part of the gas, and supplying the gas to said header means.

8. The apparatus of claim 6 further comprising:

at least one elongated header means disposed in each of said chambers and connected to said outer portions of a plurality of said tubes; and gas recirculating and cooling means arranged for withdrawing gas from said chambers, cooling all or part of the gas, and supplying the gas to said header means.

9. In a continuous annealing apparatus for metal strip having a heating zone wherein the strip is heated to an elevated temperature, a soak zone wherein the heated strip is maintained at an elevated temperature, a water quench zone wherein the heated strip is quenched, and means for moving the strip successively through said zones;

the improvement wherein a pre-quench zone is interposed between said soak zone and said water quench zone, said pre-quench zone comprising:

enclosure means including a pair of oppositely disposed outer walls and an intermediate partition wall dividing the interior of said enclosure means into a pair of parallel elongated chambers, said chambers being interconnected at one end thereof and being provided with strip inlet and exit openings at their respective opposite ends;

means in said enclosure means for directing the strip through said chambers;

cooling means including a plurality of generally U-shaped gas jet cooling tubes disposed in said chambers along the path of movement of the strip, said cooling tubes having parallel inner and outer portions extending transversely of the strip closely adjacent the opposite sides of the strip for impinging cooling gas against opposite sides of the moving strip to effect controlled cooling of the strip;

a plurality of gas-fired radiant tube heaters or electrical resistance heaters disposed in said chambers along the path of movement of the strip between said partition wall and said inner portions of said cooling tubes;

at least one elongated header means disposed in each of said chambers between said outer walls and said outer portions of said cooling tubes, said header means being connected to said outer portions of a plurality of said cooling tubes; and gas recirculating and cooling means communicating with said header means and said chambers and arranged for withdrawing gas from said chambers, cooling all or part of the gas, and supplying the gas to said header means;

said heaters being operable to retard the cooling rate of the strip below the natural cooling prevailing when said cooling means is not in use, without reducing the speed of the strip through said chambers.

10. The apparatus of claims 1 or 9 further comprising a tempering or overaging section through which the strip passes from said water quench zone, said tempering or overaging section including a heating zone wherein the strip is heated to a sub-critical temperature, a soak zone wherein the strip is maintained at the sub-critical temperature, and a cooling zone wherein the strip is cooled to substantially ambient temperature.

11. In a continuous annealing process in which a strip is moved successively through a heating zone wherein the strip is heated to a predetermined annealing temperature, a soak zone wherein the heated strip is maintained at the annealing temperature, and a water quench zone wherein the heated strip is quenched from a predetermined quench temperature; the improvement comprising:

providing a pre-quench zone between the soak zone and the water quench zone for controlling the quench temperature of the strip;

said pre-quench zone having gas jet cooling means arranged to impinge cooling gas against opposite sides of the moving strip for effecting controlled cooling of the strip to a relatively lower quench temperature, and said pre-quench zone also having independently and selectively operable gas-fired radiant tube heaters or electrical resistance heaters for imparting heat to the strip to obtain a relatively higher quench temperature, the heated metal strip moving through the pre-quench zone having a natural cooling rate resulting in an intermediate quench temperature when neither said gas jet cooling means nor said heaters are used;

cooling the strip by said gas jet cooling means at an accelerated cooling rate greater than said natural cooling rate when said predetermined quench temperature is less than said intermediate quench temperature; and imparting heat to the strip by said heaters without using said gas jet cooling means, whereby to retard the cooling rate of the strip below said natural cooling rate when said predetermined quench temperature is higher than said intermediate quench temperature.

12. The process of claim 11 wherein said predetermined quench temperature is substantially equal to said predetermined annealing temperature, and said heating means is operated to achieve a substantially zero cooling rate of the strip in the pre-quench zone.

13. The process of claim 11 wherein said quench temperature is from about 455° C. to about 955° C. (850°–1750° F.).

* * * * *